US009877618B2

(12) United States Patent
Kemp

(10) Patent No.: US 9,877,618 B2
(45) Date of Patent: Jan. 30, 2018

(54) KEMPS EASY SCRUB

(71) Applicant: Jonathan David Kemp, Rochester, PA (US)

(72) Inventor: Jonathan David Kemp, Rochester, PA (US)

( * ) Notice: Subject to any disclaimer, the term of this patent is extended or adjusted under 35 U.S.C. 154(b) by 0 days.

(21) Appl. No.: 15/135,406

(22) Filed: Apr. 21, 2016

(65) Prior Publication Data

US 2016/0309968 A1 Oct. 27, 2016

Related U.S. Application Data

(60) Provisional application No. 62/150,595, filed on Apr. 21, 2015.

(51) Int. Cl.
*A47K 7/03* (2006.01)
*A47K 7/02* (2006.01)

(52) U.S. Cl.
CPC . *A47K 7/03* (2013.01); *A47K 7/02* (2013.01)

(58) Field of Classification Search
CPC . A47K 7/03; A47K 7/02; A47K 7/022; A47K 7/026; A47K 7/028; A47K 7/00; A47K 7/08
See application file for complete search history.

(56) References Cited

U.S. PATENT DOCUMENTS 4,225,254 A * 9/1980 Holberg ..... A46B 5/02 141/18
5,704,723 A * 1/1998 Salisian ..... A47K 7/03 401/201
7,318,682 B2 * 1/2008 Anderson ..... A47K 7/03 401/183
7,419,322 B2 * 9/2008 Laflamme ..... A47K 5/1208 222/372
8,002,486 B1 * 8/2011 Tran ..... A47K 7/03 401/205

* cited by examiner

*Primary Examiner* — David Walczak
(74) *Attorney, Agent, or Firm* — Jeffrey M. Furr, Esq.; Furr Law Firm

(57) ABSTRACT

A holder for body scrubbers or synthetic loofas, which consumers everywhere love to use while bathing and showering. Liquid soap can be added to the dispenser in the holder, and it will be distributed through the sponge, making it easier to enjoy the fragrance and feel of one's favorite liquid soap while bathing.

5 Claims, 3 Drawing Sheets

KEMPS EASY SCRUB

CROSS-REFERENCES TO RELATED APPLICATIONS (IF ANY)

Priority

This applications claims priority from the disclosure of U.S. Provisional Patent Application Ser. No. 62/150,595 filed on Apr. 21, 2015, which is incorporated by reference herein.

BACKGROUND

1. Field of the Invention

The present invention relates generally to the field of holding devices and more specifically relates to a holder for body scrubbers or synthetic loofas, which consumers everywhere love to use while bathing and showering. Liquid soap can be added to the dispenser in the holder, and it will be distributed through the sponge, making it easier to enjoy the fragrance and feel of one's favorite liquid soap while bathing.

2. Description of Prior Art

Bath sponges or synthetic loofas are used to exfoliate the skin while bathing. Dead dry skin is loosened by gentling scrubbing with these textured sponges and is rinsed away by the bath or shower water, leaving the skin smooth and supple. However, it is can be difficult to use liquid body soap with these sponges, because the liquid soap seems to run right through the sponge.

Various attempts have been made to solve the problems which may be found in the related art but have thus far been unsuccessful. A need exists for a reliable Kemps Easy Scrub to avoid the above-mentioned problems.

There is still room for improvement in the art.

SUMMARY OF THE INVENTION

In view of the foregoing disadvantages inherent in the known art, the present invention provides a novel Kemps Easy Scrub. The general purpose of the present invention, which will be described subsequently in greater detail, is to provide a holder for body scrubbers or synthetic loofas, which consumers everywhere love to use while bathing and showering. Liquid soap can be added to the dispenser in the holder, and it will be distributed through the sponge, making it easier to enjoy the fragrance and feel of one's favorite liquid soap while bathing. The features of the invention which are believed to be novel are particularly pointed out and distinctly claimed in the concluding portion of the specification. These and other features, aspects, and advantages of the present invention will become better understood with reference to the following drawings and detailed description.

The current invention is more efficient, effective, accurate and functional than the current art.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

There are a number of significant design features and improvements incorporated within the invention.

As discussed above, embodiments of the present invention relate to a holder device and more particularly to a Kemps Easy Scrub.

Figure 1:
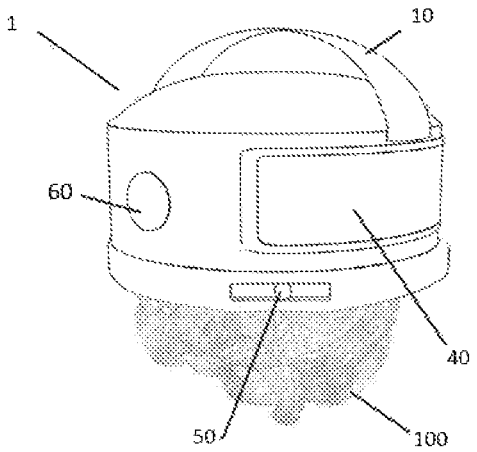
FIGS. 1-3 show various perspective views illustrating Kemps Easy Scrub according to an embodiment of the present invention.
Figure 2:
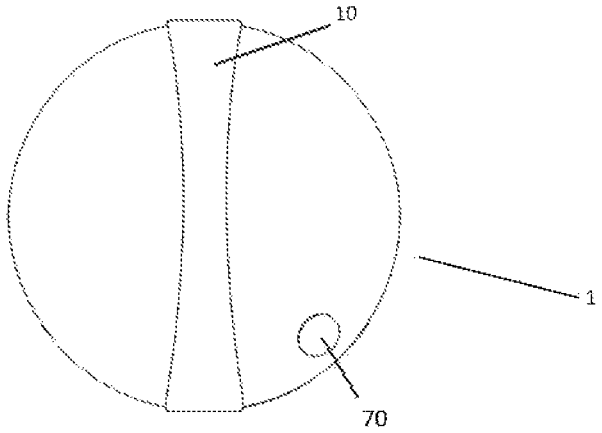
Figure 3:
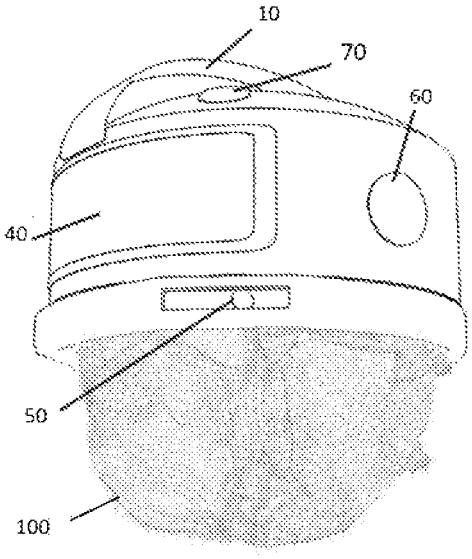

Referring now to the drawings FIGS. 1-3, Kemps Easy Scrub holder 1 is made from plastic and is approximately five inches wide and three and a half inches thick, so it is lightweight and easy to hold in one hand. The synthetic loofa 100 is secured to the bottom of the holder 1, and the user slips a hand through the strap 10 across the top of the holder 1. This allows a user to hold the scrubber 100 in his or her palm while bathing.

Figure 4:
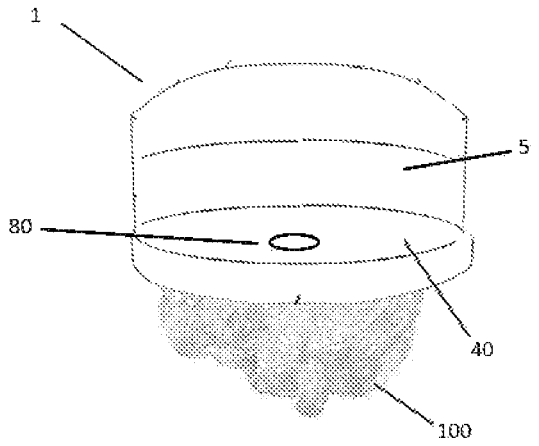
FIG. 4 shows a cut away view of the present invention.

The holder 1 has an internal soap container 40 with the body of the holder 1. The holder 1 has a small hole with a cap 70 in the top of the holder 1 for filling the internal soap container 40 with liquid soap 5. The holder 1 may have a clear side, wall or window which shows the users how much liquid soap 5 is in the soap container 40. The holder 1 has a release button 60 on the side that is pressed when needing to dispense the soap 5. Just a small amount of soap 5 is needed, and the soap 5 seeps out from the container through the openings in the loofa 100 as a person rubs his or her body with the loofa 100. The release button 60 can be a pumping mechanism or a lever to open an plug on the bottom of the holder 1. The soap 5 flows from the soap container 40 to the loofa 100 through soap dispensing openings 80 that are in the bottom of the soap container 40 as shown in FIG. 4.

The holder 1 would have a loofa securing means. In the preferred embodiment, located on the side of the holder 1 are clips 50 that secure the loofa 100. These clips 50 can be moved to release it. Other holding and release means can be used. The loofa 100 is attached to and held at the bottom of the holder 1.

It is recommended that a person using this device changes the loofa 100 regularly, as damp loofas provide good mediums for growing bacteria.

A loofa 100 can include a sponge or any other similar material commonly used as a loofa or for body washing.

The unique features of this product will provide the following benefits for consumers everywhere: Provides a convenient way to use liquid soap when bathing with a bathing sponge or synthetic loofa 100. The loofa 100 can be held comfortably in one hand, and the soap is dispensed into the center of the sponge from the internal soap container 40. The soap container 40 can be refilled easily with one's favorite liquid soap. Used loofas 100 can be released and replaced with fresh ones easily as needed.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A liquid dispensing bathing device comprised of:

a container having a cylindrical side wall, a bottom wall and a bulbous top wall wherein the container defines an interior adapted to be filled with liquid soap;

a hand strap secured to opposite ends of a top of the cylindrical side wall and which extends over the bulbous top wall;

a scrubber in the form of a sponge or luffa secured to the bottom wall;

a release button mounted on the cylindrical side wall; said release button being actuatable for enabling the flow of liquid soap in the interior of the container to flow through the bottom wall and into the scrubber;

a window in the cylindrical side wall for enabling a user to view the contents of the container;

a fill hole in the bulbous top wall for enabling the container to be filled with liquid soap; and a releasable cap covering the fill hole.

2. The liquid dispensing bathing device according to claim 1 wherein the release button actuates a pumping mechanism.

3. The liquid dispensing bathing device according to claim 1 where the liquid soap is adapted to be dispensed thorough one or more soap dispensing openings located on the bottom wall of the container.

4. The liquid dispensing bathing device according to claim 1 where the container has a mechanism to secure the scrubber.

5. The liquid dispensing bathing device according to claim 1 where the scrubber is replaceable.

* * * * *